US005409104A

United States Patent [19]

Lovell

[11] Patent Number: 5,409,104

[45] Date of Patent: Apr. 25, 1995

[54] CONTACT LENS PACKAGE HAVING IMPROVED ACCESS FEATURES

[75] Inventor: Francis J. Lovell, Paris, France

[73] Assignee: Ciba-Geigy Corporation, Ardsley, N.Y.

[21] Appl. No.: 252,614

[22] Filed: Jun. 1, 1994

[51] Int. Cl.[6] ..... B65D 85/38

[52] U.S. Cl. ..... 206/5.1; 206/467

[58] Field of Search ..... 206/5.1, 210, 467–471, 206/461–465, 532, 820

[56] References Cited

U.S. PATENT DOCUMENTS

| | | | |
|---|---|---|---|
| 3,111,220 | 11/1963 | Bostrom | 206/470 |
| 3,780,856 | 12/1973 | Braverman | 206/461 |
| 4,691,820 | 9/1987 | Martinez | 206/5.1 |
| 4,921,137 | 5/1990 | Heijenga | 206/469 |
| 5,054,610 | 10/1991 | Ajello | 206/5.1 |
| 5,337,888 | 8/1994 | Morrison | 206/5.1 |

*Primary Examiner*—Jimmy G. Foster

*Attorney, Agent, or Firm*—Edward McC. Roberts; R. Scott Meece

[57] ABSTRACT

A package for storing hydrophilic contact lenses having improved access and ease of handling. The package includes a container defining a storage reservoir and having a peripheral outwardly-extending flange, a cover for affixing to the container to provide a liquid-impermeable seal, improved means for grasping/stabilizing the container and improved means for grasping the cover during opening of the package to retrieve the contact lens retained therein.

14 Claims, 2 Drawing Sheets

CONTACT LENS PACKAGE HAVING IMPROVED ACCESS FEATURES

BACKGROUND OF THE INVENTION

1. Field of the Invention

This invention relates broadly to contact lens packaging and storage container technology. More specifically, this invention relates to "blister" or injection-molded plastic packages for storing hydrophilic or soft contact lenses immersed in a sterile saline storage solution.

2. Description of the Related Art

Hydrophilic or soft contact lenses have become quite popular because of comfort and convenience. These hydrophilic lenses generally contain from about 20% to 90% water by weight. In order to maintain this high water content, hydrophilic lenses are typically immersed in a sterile, aqueous solution within a watertight package during storing, shipping, and handling processes. There have been a variety of packages used to store hydrophilic contact lenses.

Early lens containers were stoppered glass bottles. These bottles were commonly sealed with silicone stoppers and metal foil overcaps for safety. Each bottle, having a volume of about 10 cc, carried a single contact lens immersed in about 7 cc sterile saline solution. The lens was removed by tearing the metal foil, unplugging the stopper, and grasping the lens with tweezers.

Improvements in contact lens packaging include the injection-molded or "blister" package, an example of which is disclosed in U.S. Pat. No. 4,691,820, issued to Martinez. Martinez discloses a contact lens storage package including a blister portion which defines a cavity for receiving a contact lens and saline solution. The blister portion includes an outward extending flange around the perimeter of the cavity. A cover material is affixed to the flange in order to form a watertight seal. A portion of the side wall of the blister portion is inclined away from the bottom resting surface of the blister portion. The package is opened by stripping away the cover from the flange to expose the cavity containing the contact lens. Although the Martinez package provides certain improvements, neither the package nor the cover portion are easily grasped for the opening process.

Thus, there is a need for a hydrophilic contact lens storage package having improved means for grasping the package. Also, there is a need for a contact lens storage package having an improved means for grasping and removing the cover.

SUMMARY OF THE INVENTION

An object of the invention is to provide a contact lens storage container having an improved grasping/stabilization means.

Another object of the invention is to provide a contact lens storage container having an improved access means.

A further object of the invention is to improve the comfort of the user while opening contact lens packaging.

Yet another object of the invention is to improve the location of the stabilization means of a contact lens retaining package relative to the seal means, thereby reducing the likelihood of lens or storage solution loss during the package opening procedure.

The invention is a package for storing, shipping, or other handling of soft, hydrophilic contact lenses. The package includes a container defining a reservoir capable of holding a contact lens and liquid, a cover for forming a liquid-impermeable seal with the container, and a means for affixing the cover to the container. The container further includes a means for easily and securely grasping and stabilizing the container while the cover material is being removed. The stabilizing means includes two indentations in the container, the indentations being positioned on opposite sides of the container. Preferably, the stabilizing means also includes two lips which are attached to the container indentations, and whose raised portions are substantially perpendicular to the container flange. In a preferred embodiment, the lips are ribbed for ease of manual grasping. The container also includes a means for easily accessing and grasping a portion of the cover (i.e., a pull tab), in order to separate the cover from the container and expose the contact lens stored in the reservoir. The pull tab extends a sufficient distance beyond the container to enable the user to easily grasp the tab for manual removal. Preferably, the tab includes a grasping means having raised or ribbed surfaces which aid in manual grasping of the tab.

DESCRIPTION OF THE PREFERRED EMBODIMENTS

Figure 1:
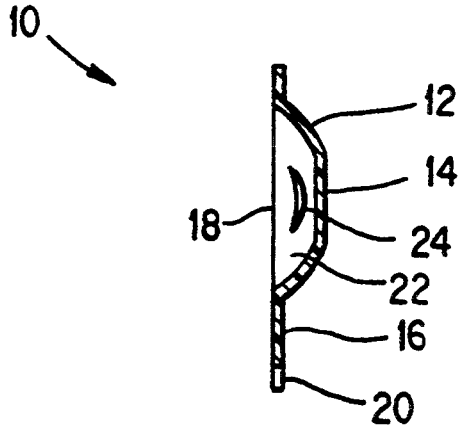
FIG. 1 is a sectional view of one embodiment of the contact lens storage package of the present invention.

Referring to FIG. 1, the contact lens storage device 10 of the present invention is shown in a sectional view. Container 12 defines a reservoir 22 for retaining a contact lens 24 and a surrounding liquid, e.g. a sterile isotonic saline solution. Container 12 preferably has substantially a semispherical shape for compatibility with the convex surface of a contact lens. Preferably, the container has a flattened surface 14, on the side opposite cover 18. This flattened surface enables the positioning and maintenance of the container in a predetermined orientation on a flat storage surface (e.g., a table). Container 12 further includes flange 16 for peripheral affixation of cover 18 thereto. Flange 16 extends from the periphery of container 12 outwardly, preferably in the plane defined by the periphery, a distance sufficient to allow affixation of cover 18 thereto. Cover 18 is a flexible sheet of material capable of providing a liquid-tight seal with container 12 when affixed thereto. Preferably, cover 18 conforms substantially to the shape of the flange 16 of container 12, except that at least one portion, pull tab 20, extends beyond flange 16. Pull tab 20 (See also FIG. 3) is provided for ease of grasping by the user during opening of the storage device to gain access to the stored contact lens.

Figure 2:
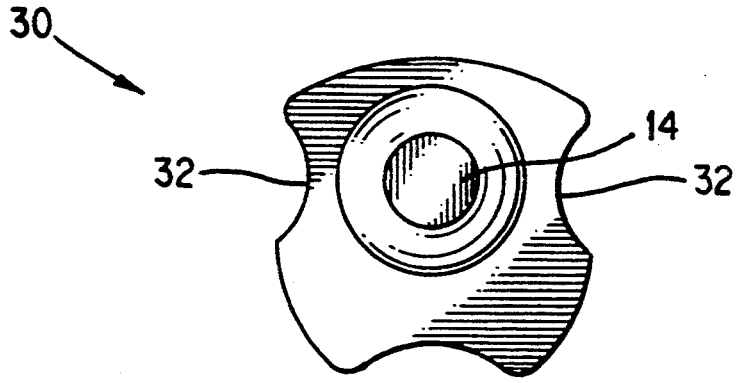
FIG. 2 is a plan view of the container component of the contact lens storage package.
Figure 3:
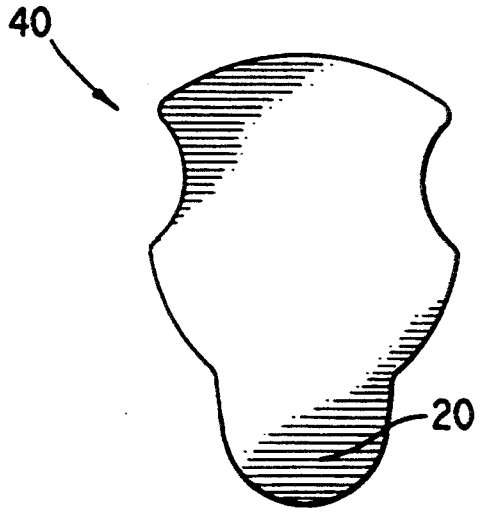
FIG. 3 is a plan view of the flexible sheet sealing means of the contact lens storage package.

FIG. 2 shows a plan view of a container 30 according to one embodiment of the present invention. Indentations 32 are provided in container 30 (preferably in the flange) in order to enable the user to grasp the container during removal of the sealing means, i.e., indentations 30 provide a means for stabilizing the container during the process of opening the container. FIG. 3 shows a preferred shape of flexible sheet 40. Sheet 40 substantially follows the shape of the container, with the exception of pull tab 20, which extends beyond the container periphery.

In operation, the user may remove the contact lens by grasping indentations 32 (See FIG. 2) with the thumb and index finger of one hand, while grasping pull tab 20 (See FIG. 3) with the thumb and index finger of the other hand. Pull tab 20 may then be moved in the direction shown by the arrow in FIG. 1, thereby breaking the seal (preferably provided by an adhesive or heat seal) between the container flange and the flexible sealing sheet.

The term "indentation", as used herein, refers to notches, nicks, impressions, cut-outs, or other shapes which provide differentiation in the periphery sufficient to enable a user to easily grasp the contact lens storage device. The indentations may be formed by cutting, stamping, molding, or otherwise shaping the flexible sheet. Preferably, the indentations are curves in the container periphery, especially the container flange, which conform substantially to the radii of curvature of the human thumb and forefingers. More preferably, the indentations have a substantially uniform radius of curvature of about 5 mm to about 30 mm.

Figure 5:
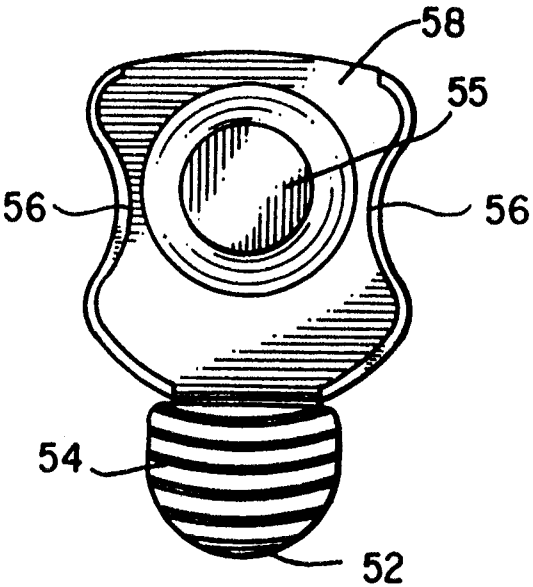
FIG. 5 is a top plan view of the second embodiment of the contact lens storage package.
Figure 4:
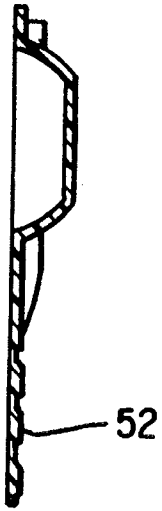
FIG. 4 is a side sectional view of a second embodiment of the contact lens storage package of the present invention.

FIG. 4 illustrates a more preferred second embodiment of the present invention. In this embodiment, pull tab 52 has surfaces with increased gripping friction provided by ribs or raised portions 54 (See FIG. 5) on pull tab 52. Pull tab 52 is removably affixed to container body 58 by affixation (e.g. by adhesive or heat sealing) to the cover (not shown in FIG. 5), which in turn is releasably affixed (e.g. by adhesive or heat sealing) to the container flange. Pull tab 52 preferably is a ribbed rigid piece of material which is particularly suited to manual grasping between the thumb and forefinger. The rigid, ribbed design allows the consumer to firmly grasp the tab. Thus, in conjunction with the side stabilizing means, the rigid, ribbed pull tab allows a smooth separation of the cover-container connection, thereby inhibiting slipping and spilling of the container contents.

Figure 6:
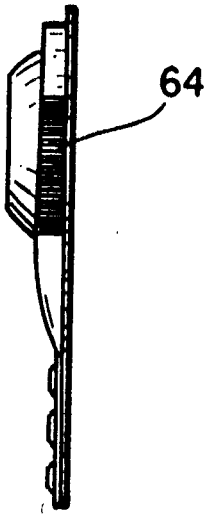
FIG. 6 is a side plan view of the second embodiment of the contact lens storage package.
Figure 7:
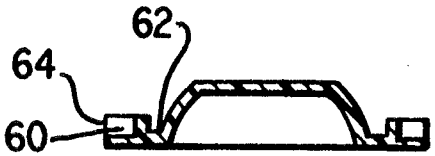
FIG. 7 is an end sectional view of the second embodiment of the contact lens storage package.

The aforementioned second embodiment is also advantageous in the utilization of stabilizing means 56 including raised lips 60 extending substantially perpendicularly from the plane defined by the flanges 58 of the container (See FIGS. 6 and 7). Lips 60 extend substantially perpendicularly away from flange 62, as best shown in FIG. 7. Preferably, raised lips 60 are ribbed or hatched on surface 64 in order to provide improved friction for ease of grasping. The lips are curved to conform to the shape of the previously-described container indentations 56 (See FIG. 5).

The relative positioning of pull tab 52 to stabilization means 56 (See FIG. 5) provides substantial improvement in the ease of removal of the contact lens from the lens storage container. During the package opening process, stabilization means 56 may be grasped between the thumb and forefinger of one hand, while pull tab 52 is grasped between the thumb and forefinger of the other hand. While pull tab 52 is moved towards stabilization means 56, the container may be easily maintained in one position by grasping stabilization means 56, thereby preventing spillage of the storage solution or loss of the lens from the container. Preferably, the container is further stabilized by resting the container against a level surface (e.g., a table) during the container opening process, with the flattened surface 55 (See FIG. 5) adjacent to the level surface.

As previously mentioned, the pull tab extends a predetermined distance beyond the periphery of the container, which distance is sufficient to enable a user to easily grasp the pull tab. Preferably, the pull tab extends about 5 millimeters (mm) to about 50 mm beyond the periphery of the container, more preferably about 15 to 25 mm beyond the container periphery.

The flexible sheet may be formed of a variety of waterimpermeable materials and may have a variety of thicknesses. The sheet must be sufficiently flexible to enable the user to easily remove the sheet from the container. Preferably, the sheet is formed from a metal (e.g., aluminum) foil or foil composite. The preferred sheet thickness is about 0.01 to about 0.10 millimeters (mm), more preferably about 0.04 to about 0.05 mm.

The container may be formed from a variety of materials, but is preferably transparent to allow the user to inspect the lens without opening the storage device. Preferred materials include a variety of transparent, moldable, substantially hydrophobic plastics, such as polyethylene or polypropylene. Preferred container thicknesses range from about 0.5 mm to about 1.0 mm.

The container may be affixed to the flexible sheet by a number of methods. However, the strength of the bond between the container and sheet should not be excessive, i.e., the user should be able to easily and quickly separate the sheet from the container. Preferred means of affixing the sheet to the container include the use of an adhesive disposed therebetween or the use of heat sealing methods, both of which are well known in the art.

The invention has been described in detail, with reference to certain preferred embodiments, in order to enable the reader to practice the invention without undue experimentation. However, a person having ordinary skill in the art will readily recognize that many of the previous disclosures may be varied or modified somewhat without departing from the scope and spirit of the invention. Accordingly, the intellectual property rights to this invention are defined only by the following claims.

What is claimed is:

1. An apparatus for storing contact lenses, comprising:

(a) a container defining a reservoir capable of receiving a contact lens and a liquid which substantially surrounds said contact lens, said container including a flange extending outwardly along the container periphery;

(b) a flexible cover, releasably affixed to said container to provide a seal which is substantially liquid impermeable;

(c) a means for stabilizing said device, including at least two indentations in said container, said indentations being positioned on opposite sides of said container, thereby enabling grasping of said device between a thumb and an index finger; and (d) a means for grasping said cover, enabling manual removal of said cover and access to said contact lens.

2. An apparatus as recited in claim 1, wherein said flexible cover comprises a flexible sheet of liquid-impermeable material.

3. An apparatus as recited in claim 2, wherein said cover is affixed to a peripheral flange on said container by an adhesive positioned between said flexible cover and said container flange.

4. An apparatus as recited in claim 3, wherein the strength of adhesion between said container and said sheet is sufficient to maintain seal integrity during container handling while being less than an amount which would substantially impair manual removal of said sheet from said container.

5. An apparatus as recited in claim 2, wherein said cover comprises a metallic foil.

6. An apparatus as recited in claim 2, wherein said flexible cover extends beyond an edge of said container, thereby forming a pull tab which extends sufficiently beyond said container edge to permit manual grasping of said flexible cover.

7. An apparatus as recited in claim 6, further including a pull tab grasping means affixed to said pull tab, wherein said pull tab grasping means is a rigid material having a plurality of raised ribs thereon.

8. An apparatus as recited in claim 6, wherein said pull tab extends about 5 mm to about 50 mm beyond said edge of said container.

9. An apparatus as recited in claim 1, wherein said container is formed from a transparent plastic.

10. An apparatus as recited in claim 1, wherein said container includes a flattened surface, positioned opposite said cover, whereby said device may be placed on a flat storage surface and maintained in a predetermined orientation.

11. An apparatus as recited in claim 10, wherein said container has a generally semispherical shape, with said flattened surface lying in a plane substantially parallel to the periphery of the semisphere, and a flange extending from the semisphere periphery to points exterior to said semisphere in the plane of the semisphere periphery.

12. An apparatus as recited in claim 1, wherein said indentations have a substantially uniform radius of curvature of about 5 to about 30 millimeters.

13. An apparatus as recited in claim 11, further comprising a pair of lips affixed to said indentations of said stabilization means, said lips extending substantially perpendicularly away from said flange and conforming substantially to the shape of said indentations.

14. An apparatus as recited in claim 13, wherein said lips have ridges extending from the surface of said lips, thereby enabling manual grasping of said lips.

* * * * *